US005410303A

United States Patent [19]

Comeau et al.

[11] Patent Number: 5,410,303

[45] Date of Patent: Apr. 25, 1995

[54] SYSTEM FOR DRILLING DEIVATED BOREHOLES

[75] Inventors: Laurier E. Comeau, Ledoc; Randal H. Pustanyk, Millet, both of Canada; Nicholas P. Wallis, Barnwood, England

[73] Assignee: Baroid Technology, Inc., Houston, Tex.

[21] Appl. No.: 190,719

[22] Filed: Feb. 1, 1994

Related U.S. Application Data

[63] Continuation of Ser. No. 879,189, May 6, 1992, abandoned, which is a continuation-in-part of Ser. No. 750,650, Aug. 27, 1991, Pat. No. 5,163,521.

[30] Foreign Application Priority Data

May 15, 1991 [GB] United Kingdom ..... 9110516

[51] Int. Cl.[6] ..... G01V 1/40

[52] U.S. Cl. ..... 340/853.3; 340/853.4; 340/853.6; 340/854.3; 340/856.1; 367/81; 367/83; 175/40; 175/45; 175/61

[58] Field of Search ..... 367/25, 81, 82, 83; 340/853.2, 853.3, 853.4, 853.5, 853.6, 854.3, 854.4, 854.5, 854.6, 854.8, 856.1; 175/40, 45, 61

[56] References Cited

U.S. PATENT DOCUMENTS 4,001,773 1/1977 Lamel et al. ..... 367/82
4,148,408 9/1992 Matthews ..... 367/82
5,160,925 11/1992 Dailey et al. ..... 340/853.3

OTHER PUBLICATIONS

A relevant portion of a Videotape entitled "MWD: An Idea Whose Time Has Come".

A portion of a lecture recorded on videotape entitled: "MWD: An Ideal Whose Time Has Come", by Kenneth R. Weeks, beginning at position 28:23, the lecture was given on Jul. 25, 1990.

A photographic image of the tool shown at the lecture, the photographic image being taken off the videotape.

A transcript of a relevant portion of the lecture recorded on videotape.

*Primary Examiner*—Ian J. Lobo

*Attorney, Agent, or Firm*—Browning, Bushman, Anderson & Brookhart

[57] ABSTRACT

Improved techniques are provided for drilling a deviated borehole through earth formations utilizing a rotary bit powered by a drill motor, and for obtaining information regarding the borehole or earth formations. A sensor permanently positioned in the drilling string between the drill bit and the drill motor detects a downhole parameter. An MWD tool may be provided within a non-magnetic portion of the drill string for receiving and transmitting a sensor representative signal to the surface. The sensor signal allows the drilling operation to be altered, and highly reliable and near-bit information thus improves the drilling operation.

48 Claims, 3 Drawing Sheets

SYSTEM FOR DRILLING DEIVATED BOREHOLES

RELATED CASE

This is a continuation of U.S. application Ser. No. 07/879,189 filed on May 6, 1992 now abandoned, which is a continuation-in-part of U.S. Ser. No. 07/750,650 filed on Aug. 27, 1991 now U.S. Pat. No. 5,163,521.

BACKGROUND OF THE INVENTION

1. Field of the Invention

The present invention relates to the drilling of boreholes and to survey and logging techniques used to determine the path and lithology of the drilled borehole. More particularly, but not exclusively, the invention is concerned with an improved system for sensing the inclination of a borehole formed by a drill bit rotated by a downhole motor, for telemetering borehole inclination and associated logging data to the surface while drilling, and for altering the drilling trajectory in response to the telemetered data.

2. Description of the Background

Drilling operators which power a drill bit by rotating the drill string at the surface have previously measured downhole parameters with sensors located closely adjacent the drill bit, and adjusted the drilling trajectory in response to the sensed information. U.S. Pat. No. 4,324,297 discloses strain gauges located directly above the drill bit to measure the magnitude and direction of side forces on the bit. The sensed information is transmitted to the surface by an electrical line, and the bit weight and rotational speed of the drill string may be altered in response to the sensed information to vary drilling trajectory.

In recent years, drilling operators have increasingly utilized downhole motors to drill highly deviated wells. The downhole motor or "drill motor" is powered by drilling mud pressurized by pumps at the surface and transmitted to the motor through the drill string to rotate the bit. The entire drill string need not be continually rotated, which has significant advantages over the previously described technique, particularly when drilling highly deviated boreholes. A bent sub or bent housing may be used above the drill motor to achieve the angular displacement between the axis of rotation of the bit and the axis of the drill string, and thereby obtain the bend to effect curved drilling. Alternatively, the angular displacement may be obtained using a bent housing within the drill motor, by using an offset drive shaft axis for the drill motor, or by positioning a non-concentric stabilizer about the drill motor housing. As disclosed in U.S. Pat. No. 4,492,276, a relatively straight borehole may be drilled by simultaneously rotating the drill string and actuating the downhole motor, while a curved section of borehole is drilled by activating the downhole motor while the drill string above the motor is not rotated. U.S. Pat. No. 4,361,192 discloses a borehole probe positioned within the drill pipe above a drill motor and connected to surface equipment via a wireline. The probe includes one or more accelerometers which measure orientation relative to the earth's magnetic field, and accordingly the probe is constructed of a non-ferromagnetic material. U.K. Patent 2106562 discloses a borehole probe which can be lowered on a wireline through a bore extending through a turbine of annular construction to a location between the turbine and the drill bit.

Significant improvements have occurred in measuring-while-drilling (MWD) technology, which allows downhole sensors to measure desired parameters and transmit data to the surface in real time, i.e., substantially instantaneously-with the measurements. MWD mud pulse telemetry systems transmit signals from the sensor package to the surface through the drilling mud in the drill pipe. Other MWD systems, such as those disclosed in U.S. Pat. Nos. 4,320,473 and 4,562,559, utilize the drill string itself as the media for the transmitted signals. U.S. Pat. No. 4,577,701 employs an MWD system in conjunction with a downhole motor to telemeter wellbore direction information to the surface, which is then used to control rotation of the drill string and activation of the downhole motor to effect a change in the borehole direction as previously described.

A downhole MWD tool typically comprises a battery pack or turbine, a sensor package, a mud pulse transmitter, and an interface between the sensor package and transmitter. When used with a downhole motor, the MWD tool is located above the motor. The electronic components of the tool are spaced substantially from the bit and accordingly are not subject to the high vibration and centrifugal forces acting on the bit. The sensor package typically includes one or more sets of magnetometers and accelerometers for measuring the direction and inclination of the drilled borehole. The tool sensor package is placed in a non-magnetic environment by utilizing monel collars in the drill string both above and below the MWD tool. The desired length of the monel collars will typically be a function of latitude, well bore direction, and local anomalies. As a result of the monel collars and the required length of the downhole motor, the sensor package for the MWD system is typically located from ten meters to fifty meters from the drill bit.

The considerable spacing between the MWD sensor package and the drill bit has long been known to cause significant problems for the drilling operator, particularly with respect to the measurement of borehole inclination. The operator is often attempting to drill a highly deviated or substantially horizontal borehole, so that the borehole extends over a long length through the formation of interest. The formation itself may be relatively thin, e.g. only three meters thick, yet the operator is typically monitoring borehole conditions or parameters, such as inclination, thirty meters from the bit. The substantial advantage of a real time MWD system and the flexibility of a downhole motor for drilling highly deviated boreholes are thus minimized by the reality that the sensors for the MWD system are responsive to conditions spaced substantially from the bit.

It is an object of the invention to provide an improved technique for accurately monitoring borehole conditions or parameters, such as borehole inclination, while drilling a deviated borehole utilizing a downhole motor.

SUMMARY OF THE INVENTION

The present invention is defined by the appended claims to which reference should be made accordingly.

BRIEF DESCRIPTION OF THE DRAWINGS

In order that the invention may be more fully understood, reference will now be made, by way of example, to the accompanying drawings, in which.

DETAILED DESCRIPTION OF THE PREFERRED EMBODIMENTS

Figure 1:
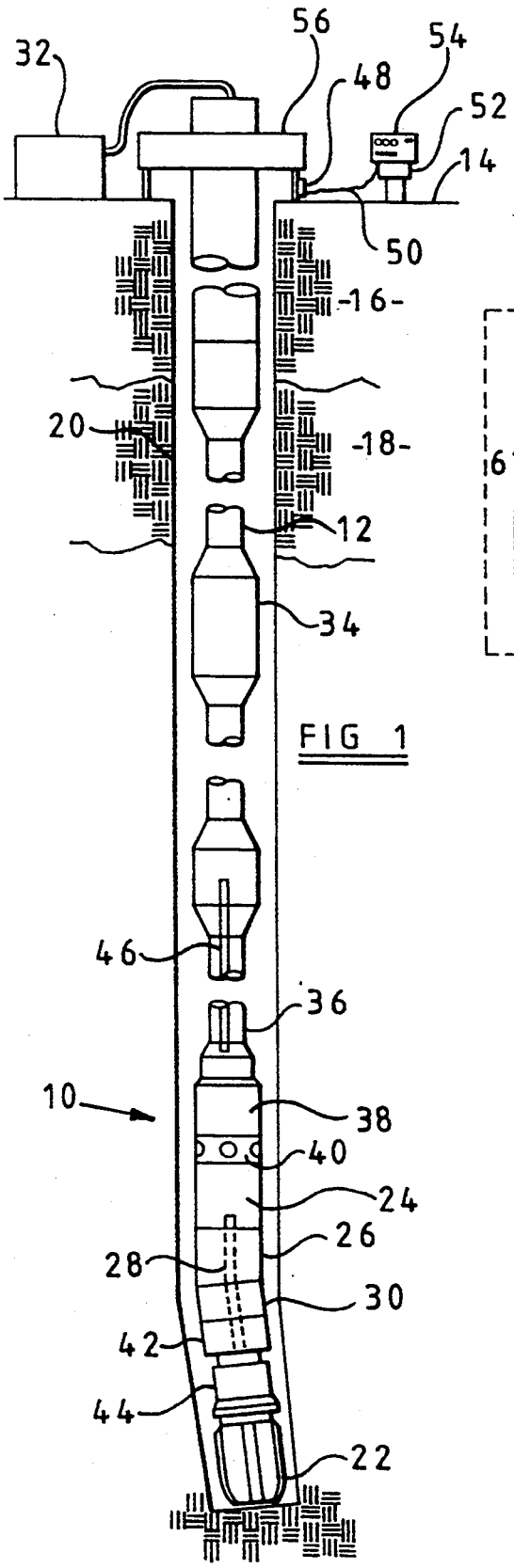
FIG. 1 is a simplified pictorial view of a drill string according to the present invention.

FIG. 1 depicts a simplified version of a system 10 for drilling a deviated borehole through earth formations while monitoring borehole characteristics or formation properties. This system includes a drill string 12 comprising lengths of conventional drill pipe extending from the surface 14 through a plurality of earth formations 16, 18. The drill string 12 is located in a borehole 20 and has at one end a rotary drill bit 22 which is powered by a fluid driven or mud motor 24. A bent sub or bent housing 26 may be provided above or below the motor 24. The motor 24 rotates a drive shaft 28, which is guided at its lower end by radial and thrust bearings (not shown) within a bearing housing 30 affixed to the housing of the mud motor. Fluid, which is commonly drilling mud, is forced by mud pumps 32 at the surface down the borehole 20 to power the motor 24. The majority of the drill string comprises lengths of metallic drill pipe, and various downhole tools 34, such as cross-over subs, stabilizer, jars, etc., may be included along the length of the drill string.

One or more non-magnetic lengths 36 of drill string, commonly referred to as monel collars, may be provided at the lower end of the drill string 12 above the drill motor 24. A conventional cross-over sub 38 preferably interconnects the lower end of a monel collar 36 with a by-pass or dump valve sub 40, and the mud motor 24 is fixedly connected directly to the sub 40. A lower bearing sub 42 is fixedly connected at the lower end of the bearing housing 30, and contains a sealed cavity with electronics, as discussed subsequently. A rotary bit sub or bit box 44 extends from the lower bearing sub 42, and is rotatable with the drill bit 22.

A significant advantage of the system 10 as shown in FIG. 1 is that the entire length of the drill string 12 need not be rotated. During straight line drilling, the drill pipe, the mud motor housing, the bearing housing, and any other housings fixed to the mud motor housing are non-rotating, and the pumps 32 power the motor 24 to rotate the shaft 28 and the bit 22. Instruments sense various downhole parameters and transmit information to an MWD (measurement-while-drilling) tool 46 located within one of the monel collars, which then transmits the information to the surface. This information may be transmitted to the surface by pressure pulses in the drilling mud in the drill string, and is received by a near surface sensor 48. The sensed information is then transmitted by lines 50 to a surface computer 52 which stores and processes the information for the drilling operator. If desired, information may be displayed in real time on a suitable medium, such as paper or a display screen 54. When the drilling operator desires to form a deviation or curve in the borehole, the mud motor 24 may remain activated while the operator rotates the rotary table 56 which then rotates the entire drill string 12. Simultaneous rotation of both the drill string and activation of the mud motor 24 causes the bit 22 to drill at an offset or deviation. During this stage of drilling, the MWD system conventionally is not transmitting data to the surface, but may still sense and briefly store data within the MWD tool 46. When the desired offset is drilled, rotation of the rotary table 56 is stopped, the drill motor 24 continues to be activated to drill the borehole at the deviated angle, and during this stage stored information may be transmitted to the surface by the MWD tool.

According to the present invention, one or more sensors located very near the drill bit 22 and below the power section of the mud motor 24 provide information to a transmitter which transmits the information to the MWD tool 46 which in turn transmits the information to the surface. The significant advantage of this arrangement is that data may be sensed very near the bit 22, rather than 20 to 100 feet up from the bit where the MWD tool is typically located. This near bit sensing allows more meaningful data to be transmitted to the surface, since the operator would like to know the characteristics of the borehole and/or the formation at a location very near the bit rather than at some location drilled hours previously.

An accelerometer or inclinometer is preferably one of the near bit sensors, since information representing the inclination of the borehole closely adjacent the bit is valuable to the drilling operator. This data cannot be easily transmitted from a near bit location to the MWD tool, however, due to the presence of the intervening mud motor 24. The necessary complexity and desirable versatility of the mud motor are not well suited to accommodate conventional data transmission lines running through the motor. It is therefore preferred that the information is transmitted from a near bit location to the MWD tool by frequency-modulated acoustic signals indicative of the sensed information. However the information my also be transmitted electromagnetically or inductively or by mud pulses, for example, and by amplitude or phase modulation or by time multiplexing rather than by frequency modulation.

Figure 2:
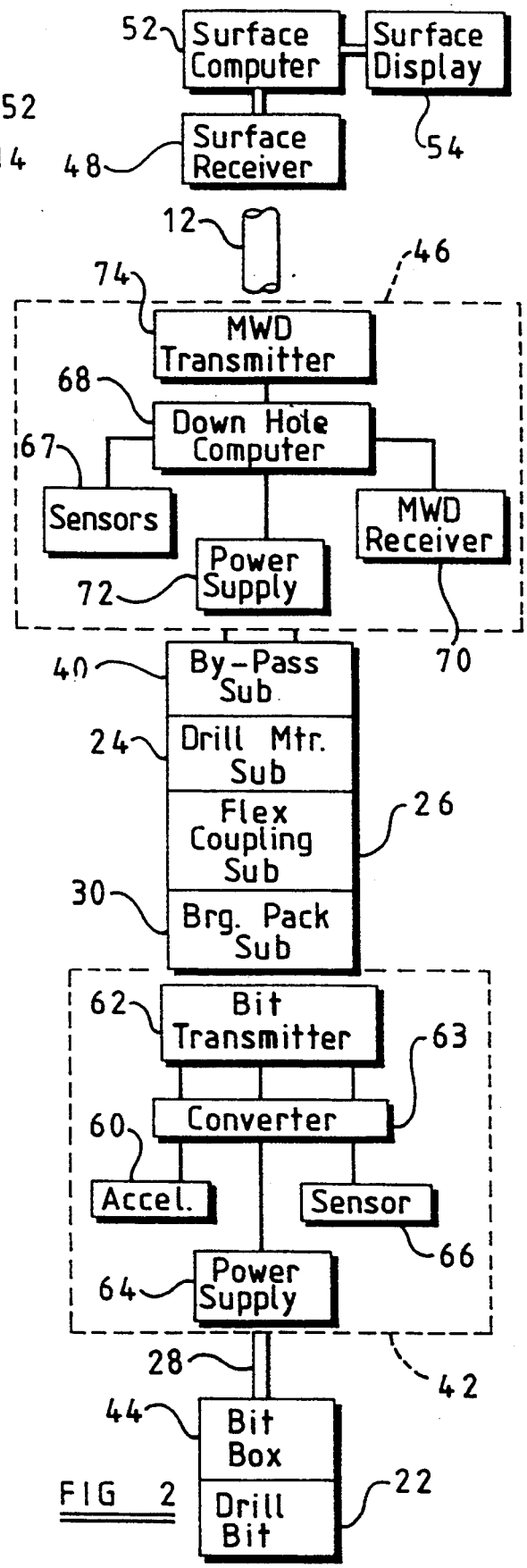
FIG. 2 is a simplified schematic diagram illustrating the components of a typical drilling and borehole surveying system according to the present invention to sense borehole trajectory and transmit sensed data to the surface for altering the drilling trajectory.

FIG. 2 generally depicts in block diagram form the primary components of the system according to the present invention, and the same numeral designations will be used for components previously discussed. The lower bearing sub 42 includes a sealed cavity which houses an accelerometer 60, a near bit acoustic transmitter 62, a power supply 64, and optionally one or more sensors 66 other than the accelerometer 60. The output signal from the or each sensor is passed to a voltage-to-frequency convertor 63 which converts sensor voltage signals to frequency signals which are in turn used to modulate acoustic signals transmitted by the transmitter 62. The signals from the transmitter 62 pass through the metal casings between the lower bearing sub 42 and an MWD receiver 70 within the monel collar 36. The transmitted signals are acoustic signals preferably having a frequency in the range of 500 to 2000 Hz. Acoustic signals may be efficiently transmitted for a distance of up to 100 feet through either the drilling mud or the metal casings. Alternatively, radio frequency signals of from 30 kHz to 3000 MHz may be used.

The MWD tool 46 includes a magnetometer or other magnetic sensor 66, a downhole data storage device or computer 68, an MWD acoustic receiver 70, a power supply 72, and an MWD mud pulse transmitter 74. Although it is generally preferred that the borehole or formation characteristics be sensed at a location below the drill motor 24, the magnetometer must be magnetically isolated from the metal housings for reasonable accuracy and reliability, and accordingly it is housed within the monel collar 36. If desired, other sensors, such as backup sensors, could also be provided within the monel collar 36, although preferably sensors other than the magnetic sensor are located at the near bit location. In addition to the inclinometer or accelerator 60, near bit sensors provided within the sub 42 may include a weight-on-bit sensor, a torque sensor, a resistivity sensor, a neutron porosity sensor, a formation density sensor, a gamma ray count sensor, and a temperature sensor. Data from each of these sensors may thus be transmitted by the transmitter 62 to the MWD receiver 70.

The computer 68 includes both temporary data storage and data processing capabilities. In particular, information from various sensors may be encoded for each sensor and arranged by the computer so that like signals will be transmitted to the surface, with the signals from each sensor being coded for a particular sensor. Porosity signals, magnetometer signals, resistivity signals, inclination signals and temperature signals may thus be intermittently transmitted to the surface by the MWD transmitter 74. The receiver 70, computer 68, transmitter 74 and any sensors within the monel collar are all powered by the power supply 72.

Figure 3:
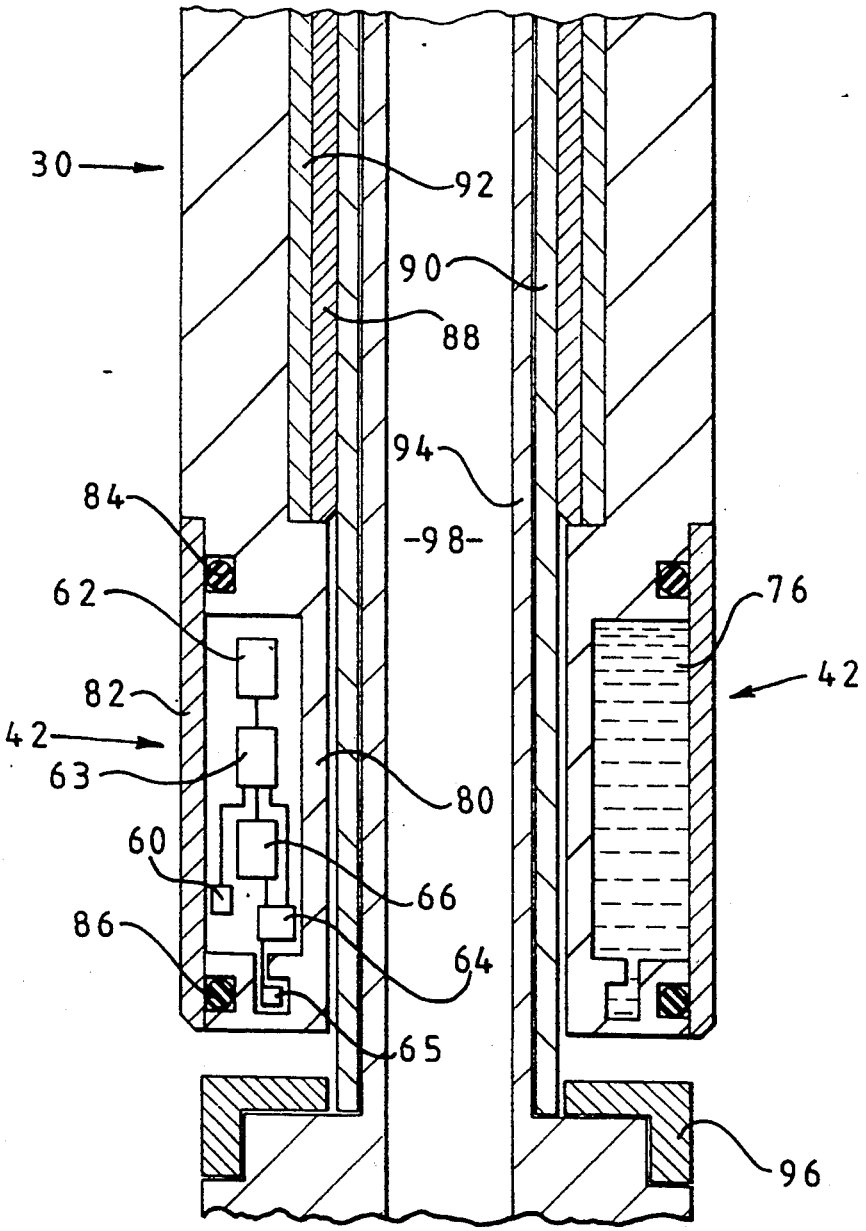
FIG. 3 is an axial section through a lower portion of a drill motor housing according to the present invention schematically showing certain components within a sealed cavity in the motor housing.

FIG. 3 shows the lower bearing sub 42 at the lower end of the bearing housing 30 which is in turn secured to the end of the bent sub or bent housing 26. The sub 42 incorporates a sealed annular cavity 76 for the near bit sensing components shown schematically in FIG. 2 within the sub 42. In non-illustrated variants of the invention the sub 42 may be part of the assembly consisting of the mud motor 24 or the bearing housing 30, and optionally may also include the bent sub or housing 26, and the sealed cavity may be formed by the sub 42 or by the housing for either the mud motor 24, the sub 26 or the housing 30. Alternatively the cavity may be formed in the drill bit itself.

The lower bearing sub 42 includes an integral recessed lower body 80 to define the cavity 76, and an outer sleeve 82 which is threadably connected to the body 80, with a fluid-tight seal being formed by O-rings 84 and 86 between radially outer portions of the body 80 and the sleeve 82. A wear sleeve 92 and a radial bearing 88 are positioned within the sub 42. The inner cylindrical surface of the radial bearing 88 is slightly less than the inner diameter of body 80, so that a sleeve extension 90 of a lower spacer sleeve normally engages the radial bearing 88 but not the body 80. The spacer sleeve and thus the extension 90 are attached to a mandrel 94, which is rotated by the drive shaft 28, so that the sleeve extension 90 and the mandrel 94 rotate with respect to the body 80. A mandrel ring 96 is attached to the mandrel 94 to secure the lower end of the sleeve extension 90 in place. The mandrel 94 defines a cylindrical full bore 98 for passing the drilling fluid to the bit, and the bit box 44 may be threadably secured directly to the lower end of the mandrel 94.

The sealed cavity 76 houses the acoustic transmitter 62, the accelerometer 60 for measuring the component (Gz) of the earth's gravitational field in the axial direction of the drill bit, the voltage-to-frequency convertor 63 and the power supply 64 which may consist of a lithium battery pack or generator assembly. Any number of additional sensors represented by 66 may be provided within the sealed cavity to monitor near bit information. If desired, a small computer may also be provided within the cavity 76 to provide temporary data storage functions. The computer may include timing programs or signal conditioning circuitry to regulate the timing for transmitting frequency modulated acoustic signals for each of the sensors from the transmitter 62 to the receiver 70. Also, a turbine or eddy current generator 65 may be provided for generating electrical power to recharge the battery pack 64 or to directly power the sensors, computer and transmitter within the cavity 76. The generator 65 is stationary with respect to the adjoining rotary mandrel 94, and accordingly my be powered by the mandrel driven by the motor 24.

Figure 4:
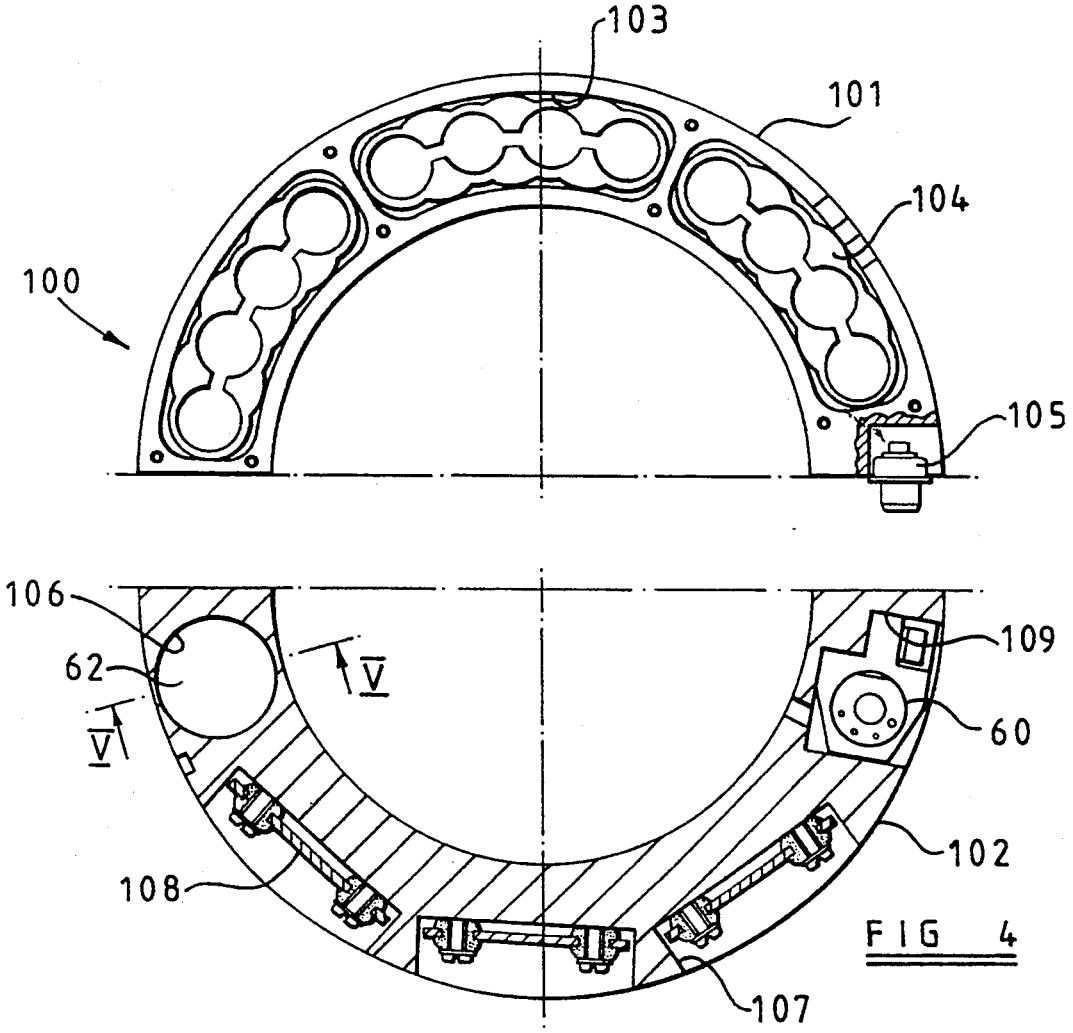
FIG. 4 is an end view of two assembly parts to be accommodated within the sealed cavity of the motor housing.

Referring to FIG. 4 the components housed within the sealed cavity 76 are located within a split cylindrical potted mould 100, shown in FIG. 4, comprising a battery mould part 101 and an electronics mould part 102 for the other components. The battery mould part 101 has three axially extending arcuate chambers 103, each of which contains a respective moulded silicone rubber sleeve 104 for accommodating four pairs of lithium batteries side-by-side. The battery mould part 101 also includes wiring (not shown) connecting the batteries to an electrical connector 105 for engaging a complementary connector (not shown) on the electronics mould part 102. The electronics mould part 102 has an axial chamber 106 for the transmitter 62, three recesses 107 for circuit boards 108 of control circuitry and an axial chamber 109 for the accelerometer 60. Although not visible in FIG. 4, the electronics mould part 102 also has a recess for a tensioning device which tensions a retaining strap for extending around the two mould parts 101 and 102 to retain the mould parts in position within the cavity 76. The control circuitry includes an analogue control circuit for the accelerometer 60, a signal conditioning circuit for encoding the sensor data for transmission, and a timing circuit for enabling the transmitter to be powered on after a preset delay. In addition circuitry may be provided for actuating the transmitter only after drilling has stopped, either in response to an acoustic pickup which senses that drilling noise has stopped or in response to an acoustic signal from the MWD receiver 70 sensed by a piezoelectric receiving device. In addition the battery mould part 101 has detachable upper and lower covers (not shown).

Figure 5:
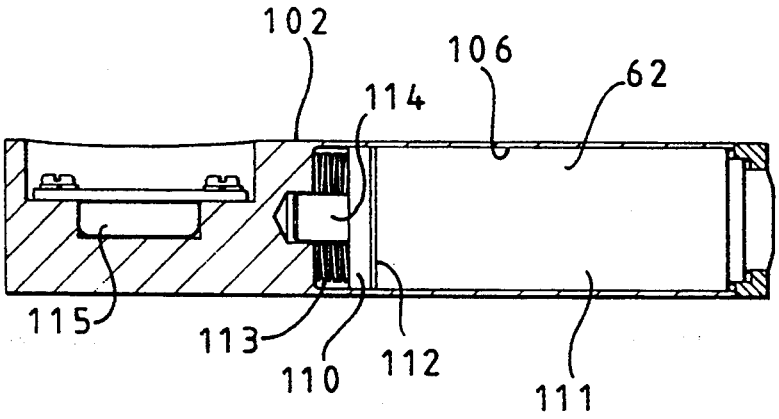
FIG. 5 is an axial section through an acoustic transmitter of one of the assembly parts.

Referring to FIG. 5, which shows a section through the electronics mould part 102 taken along the line V—V in FIG. 4, the acoustic transmitter 62 comprises two coaxial cylindrical pole pieces 110 and 111 separated by an annular air gap 112 and interconnected by an axial rod (not shown) made of magnetostrictive material. The axial rod is surrounded by a cylindrical coil within the pole piece 111, and the supply of a suitable input signal to the coil results in physical deformation of the rod in such a manner as to produce an acoustic output signal. The air gap 112 is provided to allow the rod to extend and contract without constraint, and a prestress system including a compression string 113 surrounding a stud 114 serves to compress the pole pieces 110 and 111 in the axial direction.

Those skilled in the art should now appreciate the numerous advantages of the system according to the present invention. A fast, accurate, and low cost technique is provided for reliably obtaining and transmitting valuable near bit information past the drilling motor and to the surface. In particular, well bore inclination may be monitored at a near bit position, although well bore direction may be reliably sensed and transmitted to the surface from a position above the drill motor. Complex and unreliable hard-wiring techniques are not required to pass the information by the drill motor. Although reliable near bit information is obtained, the sensors are not normally rotated during ongoing drilling operations, so that the sensors and electrical components within the sealed cavity 76 are not subject to centrifugal forces caused by drill bit rotation in the 50 to 6000 RPM range. Also, if required,data may be transmitted to the surface during the drilling mode, thereby saving valuable drilling time. Moreover, the sub 42 is substantially isolated from the high vibrational forces acting on the drill bit due to the various bearing assemblies within the bearing housing 30. The angular or orientational position of the sensors within the sealed cavity 76 is fixed, and thus the position of any sensor with respect to the sub 42 and thus the drill string 12 may be determined and recorded.

We claim:

1. A method of signalling within a borehole while drilling using a drill string having a drill bit at a lower end thereof, the drill bit being selectively powered by a downhole drilling motor within the drill string, the downhole drilling motor including a power assembly for rotating the drill bit, and a downhole drilling motor housing stationary with respect to the drill string above the power assembly of the drilling motor, the method comprising:

detecting a downhole parameter with a sensor located in the drill string below the power assembly of the drilling motor and stationary with respect to the downhole drilling motor housing;

transmitting a signal representative of the detected downhole parameter along the drill string from a lower downhole location in the drill string below the power assembly of the drilling motor to an upper downhole location in the drill string axially opposite the sensor with respect to the drilling motor;

receiving said signal at said upper downhole location in the drill string;and transmitting data indicative of said signal from said upper downhole location in said drill string to the surface.

2. A method according to claim 1, further comprising:

positioning the sensor in a cavity within an outer housing below the power assembly of the downhole motor.

3. A method according to claim 1, wherein the step of transmitting the signal comprises:

generating and transmitting an acoustic signal representative of the detected downhole parameter.

4. A method as defined in claim 3, further comprising:

position a rod within a cavity within an outer housing adjacent to its drill bit;

positioning a coil about the rod;

inputting a signal to the coil functionally related to the detected downhole parameter to deform the rod to produce the acoustic output signal.

5. A method according to claim 1, wherein the step of transmitting data comprises;

generating and transmitting mud pulse signals from said upper downhole location to the surface.

6. The method according to claim 1, wherein the step of transmitting the signal comprises:

encoding the signal representative of the detected downhole parameter; and initiating the transmission of the signal along the drill string in response to a control signal.

7. The method of claim 1, wherein the step of transmitting a signal representative of the detected downhole parameter along the drill string further comprises:

transmitting the signal representative of the detected downhole parameter utilizing the metal housing of the drilling motor as a signal flow path for the transmitted signal.

8. Apparatus for signalling within a borehole while drilling using a drill string having a drill bit at a lower end thereof, the drill bit being selectively powered by a downhole drilling motor within the drill string, the downhole drilling motor including a power assembly for rotating the drill bit, and a downhole drilling motor housing stationary with respect to the drill string above the power assembly of the drilling motor, the apparatus comprising:

a sensor within the drill string at a stationary position with respect to the downhole drilling motor housing below the power assembly of the drilling motor to detect a downhole parameter and generate an output indicative of the detected downhole parameter;

a first downhole transmitter positioned within the drill string at a stationary position with respect to the downhole drilling motor housing below the power assembly of the drilling motor to receive the output from the sensor and transmit a signal along the drill string representative of the sensor output;

a downhole receiver positioned within the drill string axially opposite the sensor with respect to the drilling motor for receiving the signal transmitted by the first transmitter; and a second downhole transmitter positioned within the drill string axially opposite the sensor with respect to the drilling motor for receiving the signal from the downhole receiver and for transmitting data indicative of the signal to the surface.

9. Apparatus according to claim 8, wherein the first downhole transmitter is an acoustic transmitter, and the second downhole transmitter is a mud pulse transmitter.

10. Apparatus according to claim 8, further comprising:

another sensor within the drill string positioned below the power assembly of the drilling motor for detecting another downhole parameter and generating the output indicative of the detected another downhole parameter; and the second downhole transmitter transmits data to the surface indicative of the output from the another sensor.

11. Apparatus according to claim 10, wherein the first downhole transmitter comprises:

a magnetostrictive member;

magnetic field means for applying a magnetic field to said magnetostrictive member as a function of the sensor output to produce an acoustic signal representative of the sensor output.

12. Apparatus according to claim 11, further comprising:

the magnetostrictive member includes first and second pole pieces separated by an air gap; and a compression member for axially comprising the first and second pole pieces.

13. Apparatus according to claim 8, further comprising:

a bend within the drill string below the power assembly of the drilling motor; and the sensor is fixedly positioned within the drill string below the bend.

14. Apparatus according to claim 13, wherein:

the drilling motor includes a lower bearing assembly; and the sensor is fixedly positioned within the drill string below the bearing assembly of the drilling motor.

15. A data sensing and transmission assembly for positioning within a lower end of a drill string during drilling and axially below a power section of a downhole motor selectively rotating a drill bit, the downhole drilling motor having a housing stationary with respect to a rotatable shaft for interconnecting the power section and the drill bit, the assembly comprising:

the drill motor housing having a sealed cavity therein;

a sensor within the sealed cavity for detecting a downhole parameter and generating an output indicative of the detected downhole parameter; and a transmitter within the sealed cavity for receiving the output from the sensor indicative of the detected downhole parameter and for transmitting a signal along the drill string representative of the sensor output to a position axially above the power section of the downhole motor.

16. An assembly according to claim 15, wherein the transmitter comprises:

a magnetostrictive member; and magnetic field means for applying a magnetic field to said magnetostrictive member in response to the sensor output to produce an acoustic signal representative of the sensor output.

17. The assembly according to claim 15, wherein the housing is a drilling motor bearing housing, and the sensor is rotationally fixed within the drilling motor bearing housing.

18. The assembly according to claim 15, further comprising:

providing a power supply within the sealed cavity for powering the transmitter.

19. The assembly according to claim 15, wherein the transmitter transmits acoustic signals having a frequency in the range of from 500 to 2,000 Hz.

20. The assembly according to claim 15, wherein the transmitter comprises:

a voltage to frequency converter within the sealed cavity for receiving voltage signals from the sensor and generating frequency signals in response thereto.

21. The assembly according to claim 15, further comprising:

a downhole computer within the sealed cavity for storing the transmitted signals.

22. The assembly according to claim 15, further comprising:

another sensor within the sealed cavity for detecting another downhole parameter; and the transmitter transmits another signal indicative of the output from the another sensor.

23. The assembly according to claim 15, further comprising:

a bend in the drill string below the power section of the downhole motor;and the sensor and the transmitter are each positioned within the sealed cavity of the housing below the bend in the drill string.

24. The assembly according to claim 23, wherein:

the drilling motor includes a lower bearing assembly; and the sensor is fixedly positioned within the drill string below the bearing assembly of the drilling motor.

25. A method of signalling within a borehole while drilling using a drill string having a drill bit at a lower end thereof, the drill bit being selectively powered by a downhole drilling motor within the drill string, the downhole drilling motor including a power assembly for rotating the drill bit, and a drilling motor housing stationary with respect to a drive shaft passing through the drilling motor housing and interconnecting the power assembly and the drill bit, the method comprising:

providing a plurality of sensors within a sealed cavity in a sensor housing below the power assembly of the downhole motor, the sensor housing being stationary with respect to the drilling motor housing;

detecting one or more downhole parameters with the plurality of sensors;

transmitting one or more signals representative of the detected one or more downhole parameters along the drill string from a lower downhole location in the drill string below the power assembly of the drilling motor to an upper downhole location in the drill string axially opposite the plurality of sensors with respect to the drilling motor;

receiving said one or more signals at said upper downhole location in the drill string;and transmitting data indicative of said one or more signals from sand upper downhole location in said drill string to the surface.

26. A method according to claim 25, further comprising:

storing said one or more signals downhole.

27. A method according to claim 25, wherein the step of transmitting data comprises:

generating and transmitting mud pulse signals from said upper downhole location to the surface.

28. The method according to claim 25, further comprising:

providing a bend in the drill string below the power assembly of the downhole drilling motor;and positioning the plurality of sensors in the sealed cavity below the bend.

29. A method of signalling within a borehole while drilling using a drill string having a drill bit at a lower end thereof, the drill bit being selectively powered by a downhole drilling motor within the drill string, the downhole drilling motor including a power assembly for rotating a drill bit, and a downhole drilling motor housing stationary with respect to the rotating drill bit, the method comprising:

detecting a downhole parameter with a sensor located in the drill string below the power section of the drilling motor and stationary with respect to the drilling motor housing;

transmitting a signal representative of the detected downhole parameters along the drill string from a lower downhole location in the drill string below the power assembly of the drilling motor to an upper downhole location in the drill string axially opposite the sensor with respect to the drilling motor;

receiving said signal at said upper downhole location in the drill string;

transmitting data indicative of said signal in real time from said upper downhole location in said drill string to the surface; and altering drilling trajectory in response to the transmitted data.

30. A method as defined in claim 29, further comprising:

storing said signal downhole at a location above the power assembly of the drilling motor.

31. A method according to claim 29, wherein the step of transmitting data comprises:

generating and transmitting mud pulse signals from said upper downhole location to the surface.

32. The method according to claim 29, further comprising:

providing a bend in the drill string below the power assembly of the downhole drilling motor;and positioning the sensor in the drill string below the power assembly of the drilling motor.

33. The method according to claim 32, further comprising:

providing a lower bearing assembly within the downhole drilling motor;and positioning the sensor below the lower bearing assembly.

34. Apparatus for signalling within a borehole while drilling using a drill string having a drill bit at a lower end thereof, the drill string including a bent housing for effecting directional drilling, the drill bit being selectively powered by a downhole drilling motor within the drill string, the downhole drilling motor including a power assembly for rotating the drill bit, and a downhole drilling motor housing stationary with respect to the bent housing in the drill string, the apparatus comprising:

a sensor within the drill string at a stationary position with respect to the downhole drilling motor housing below the power assembly of the drilling motor to detect a downhole parameter and generate an output indicative of the detected downhole parameter;

a first downhole transmitter positioned within the drill string below the power assembly of the drilling motor to receive the output from the sensor and a transmit a signal along the drill string representative of the sensor output;

a downhole receiver positioned within the drill string axially opposite the sensor with respect to the drilling motor for receiving the signal transmitted by the first transmitter;

a second downhole transmitter positioned within the drill string axially opposite the sensor with respect to the drilling motor for receiving the signal from the downhole receiver and for transmitting data indicative of the signal to the surface; and a downhole memory unit within the drill string for storing data indicative of the detected downhole parameter.

35. Apparatus according to claim 34, further comprising:

another sensor within the drill string positioned below the power assembly of the drilling motor for detecting another downhole parameter and generating an output indicative of the detected another downhole parameter; and the second downhole transmitter transmits data to the surface indicative of the output from the another sensor.

36. Apparatus as defined to claim 35, further comprising:

one or more sealed cavities within an annular sensor housing below the power assembly of the downhole motor for receiving the sensor and the another sensor, said drill bit being rotatable with respect to said annular sensor housing.

37. Apparatus according to claim 34, further comprising:

a downhole power supply for powering said sensor.

38. Apparatus as defined in claim 37, wherein said power supply is driven in response to rotation of a drive shaft rotating the drill bit.

39. The apparatus according to claim 34, further comprising:

the bent housing in the drill string is below the power assembly of the downhole motor; and the sensor and the first downhole transmitter are each positioned within the drill string below the bent housing.

40. A data sensing and transmission assembly for positioning within a lower end of a drill string during drilling and axially below a power section of a downhole motor selectively rotating a drill bit, the downhole motor including an outer motor housing stationary with respect to the rotating it, the assembly comprising:

a sensor housing below said power assembly of said downhole motor and stationary with respect to the drilling motor housing, the sensor housing having one or more sealed cavities therein;

a plurality of sensors within the one or more sealed sensor cavities for detecting one or more downhole parameters and generating an output indicative of the detected downhole parameters; and a transmitter within one or more sealed cavities for receiving the output from the plurality of sensors indicative of the detected downhole parameters and for transmitting a signal along the drill string representative of the output to a position axially above the power section of the downhole motor.

41. The assembly as defined in claim 40, wherein said transmitter transmits mud signals to the surface.

42. The assembly as defined in claim 40, further comprising:

a bend in the drill string below the power section of the downhole motor; and the sensor housing is positioned within the downhole motor below the bend.

43. Apparatus for signalling within a borehole along a drill string having a drill bit at a lower end thereof and bet housing in the drill string for effecting directional drilling, the drill bit being selectively powered by a downhole drilling motor within the drill string, the downhole motor including a power assembly for rotating the drill bit, and a downhole motor housing stationary with respect to the bent housing in the drill string, the apparatus comprising:

one or more sensor positioned within the drill string below the power assembly of the drilling motor at a stationary position with respect to the downhole motor housing to detect one or more downhole parameters and generate one or more outputs indicative of the one or more detected downhole parameters;

a downhole transmitter positioned within the downhole motor housing below the power assembly of the drilling motor for transmitting signals representative of the one or more sensor outputs;

a signal connection between the downhole transmitter and each of the one or more sensors to allow the downhole transmitter to receive the one or more sensor outputs; and a receiver positioned uphole with respect to the power assembly of the downhole drilling motor for receiving the signals from the downhole transmitter.

44. The apparatus of claim 43, wherein each of the one or more sensors is fixably mounted within the downhole motor housing.

45. The apparatus of claim 43, wherein the downhole transmitter is positioned within a bearing housing portion of the downhole motor housing.

46. Apparatus for signalling within a borehole along a drill string having a drill bit at a lower end thereof, the drill bit being selectively powered by a downhole drilling motor within the drill string,the downhole drilling motor including a power assembly for rotating the drill bit, a rotary shaft interconnecting the power assembly and the drill bit, and a drilling motor housing stationary with respect to the rotary shaft, the apparatus comprising:

a bent housing stationary with respect to the drilling motor housing and stationary with respect to the rotating drill bit;

a bearing housing fixably positioned with respect to the bent housing a stationary with respect to the rotating drill bit;

a mandrel powered by the power assembly and rotatable within the bearing housing;

a sensor housing disposed downhole below the power assembly of the drilling motor, the sensor housing being stationary with respect to drilling motor housing;

a sensor fixably secured within the sensor housing to detect a downhole parameter and generate an output indicative of the detected downhole parameter; and a downhole transmitter secured within the sensor housing for receiving the output of the sensor and transmitting a signal representative of the detected downhole parameter.

47. The apparatus of claim 46, wherein the sensor housing and the bearing housing are an integral housing.

48. The apparatus of claim 46, wherein the sensor housing and the bent housing are an integral housing.

* * * * *

UNITED STATES PATENT AND TRADEMARK OFFICE

CERTIFICATE OF CORRECTION

PATENT NO. : 5,410,303

DATED : April 25, 1995

INVENTOR(S) : Laurier E. Comeau, Randal H. Pustanyk, and Nicholas P. Wallis

It is certified that error appears in the above-indentified patent and that said Letters Patent is hereby corrected as shown below:

In column 10, line 40, change "sand" to --said--.

In column 11, line 53, delete "a" before "transmit".

In column 12, line 34, change "it" to --bit--.

In column 12, line 59, change "bet" to --bent--.

In column 14, line 8, change "a" to --and--.

Signed and Sealed this

Seventh Day of November, 1995

Bruce Lehman

*Attest:*

BRUCE LEHMAN

*Attesting Officer*

*Commissioner of Patents and Trademarks*